United States Patent [19]

Spademan

[11] Patent Number: 4,494,324

[45] Date of Patent: Jan. 22, 1985

[54] DYNAMIC INTERNAL FITTING SYSTEM WITH A MOVABLE FOOT BED FOR A SPORT SHOE

[76] Inventor: Richard G. Spademan, Box 6410, Incline Village, Nev. 89450

[21] Appl. No.: 50,436

[22] Filed: Jun. 20, 1979

Related U.S. Application Data

[63] Continuation-in-part of Ser. No. 886,946, Mar. 15, 1978, Pat. No. 4,382,342.

[51] Int. Cl.[3] ..... A43B 5/04; A43B 5/16

[52] U.S. Cl. ..... 36/119; 36/120

[58] Field of Search ..... 36/119, 117, 120, 121

[56] References Cited

U.S. PATENT DOCUMENTS

| | | | |
|---|---|---|---|
| 3,775,872 | 12/1973 | Rathmell | 36/119 |
| 3,828,448 | 8/1974 | Leonildo | 36/119 |
| 3,883,964 | 5/1975 | Check | 36/119 |
| 4,160,332 | 7/1979 | Salomon | 36/119 |

FOREIGN PATENT DOCUMENTS

| | | | |
|---|---|---|---|
| 2086994 | 12/1971 | France | 36/119 |

*Primary Examiner*—Werner H. Schroeder

*Attorney, Agent, or Firm*—Townsend and Townsend

[57] ABSTRACT

The present invention relates to internal fitting systems for sport shoes in general, and in particular to a novel internal fitting system for a ski boot used for downhill skiing or the like.

15 Claims, 2 Drawing Figures

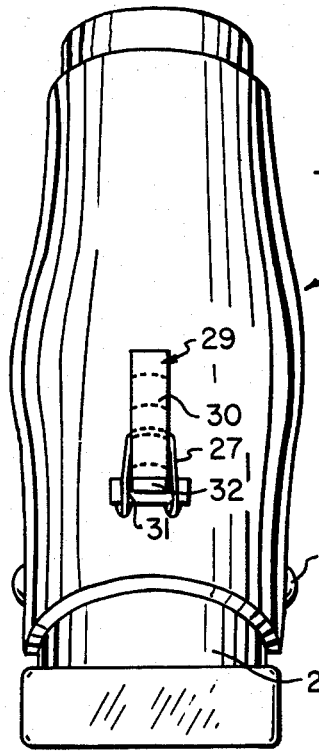
FIG. 2
FIG. 1
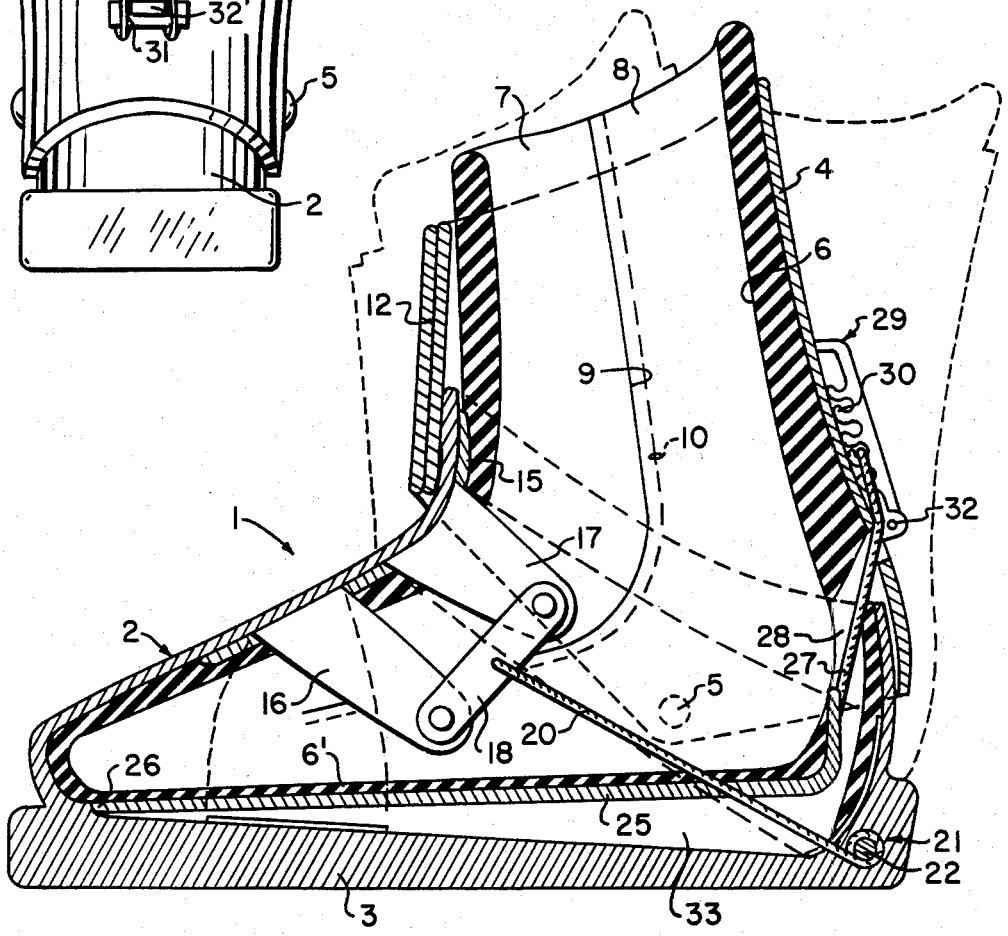

DYNAMIC INTERNAL FITTING SYSTEM WITH A MOVABLE FOOT BED FOR A SPORT SHOE

RELATED APPLICATION

This is a Continuation-in-Part of Application Ser. No. 886,946, filed Mar. 15, 1978, now U.S. Pat. No. 4,382,342.

BACKGROUND OF THE INVENTION

Conventional ski boots as presently used in downhill skiing typically comprise a rigid exterior lower shell member, a relatively stiff upper cuff member and a relatively soft interior liner. The shell and cuff members are generally designed to provide physical protection and mechanical support for a foot, ankle and lower leg and to provide a stable means for releasably securing the boot to a ski. Specifically, the lower shell and cuff members are constructed to provide a restraint against excess sideways and rearward bending at the ankle while providing limited forward bending of the leg relative to the foot. Frequently, depending on the intended use of the boot and often on the ability of the skier, the cuff member of the boot is pivotally connected to the lower shell member so as to permit a limited degree of forward and rearward lean or bending of the lower leg relative to the foot. More advanced skiers frequently use boots constructed without a pivoting cuff member and, in those cases, forward bending is restricted or permitted to a limited extent by a provision for a separation of the upper forward section of the cuff member. The interior liner is provided for warmth and general comfort and, as will be seen, also to adapt a single shell design and size to feet of various shapes and sizes.

The manufacture of the relatively rigid shells and cuff members and the molds for fabricating them are expensive. Because of this expense, manufacturers have resorted to the use of various types of liners that attempt to accommodate a wide range of foot sizes and shapes such as a splay or wide forefoot, wide base, angulated heel, halux valgus, bony prominences, spurs, high longitudinal arch or one foot in size variance with the other foot. Among the constructions used for liners there are included molded and sheet foam rubber, urethane foam, wax, cork, plastic beads and other various flow materials. Indeed, the number of different materials and constructions employed is indicative of the difficulty of the problem of fitting sport shoes in general and ski boots in particular and the unsatisfactory results that have been achieved heretofore. One of the principal reasons is that conventional boots and conventional liners do not provide adequate adjustment for comfort and restraint under all skiing conditions.

A well designed ski boot should not only provide warmth and comfort; it should also provide adequate restraint and a fit which varies in accordance with the dynamic conditions that prevail in downhill skiing. With conventional boots, during a turn, when skiing on packed snow, forward bending at the ankle is usually accompanied by a tendency for hind-foot upward movement and forefoot sideways movement because ski control in turning is usually accomplished by downward and sideways force applied to the forward leading edges of the skis. In powder snow, the forward leading edges are kept raised for planing on top of the snow with a tendency for forefoot upward and sideways movement. When maneuvering in snow of different consistencies, or in bumpy or mogly terrain, the skier alternates frequently and rapidly between forward and rearward leaning in the boots. When, under such conditions, excessive foot movement occurs in a boot, ski control is significantly reduced. In most injury-producing fall conditions, such excess movement also reduces energy transmission between the foot and the release binding, thus impairing a release.

To avoid excessive movement of a foot in a ski boot, skiers, heretofore, frequently were forced to overly tighten the boot by tightening the buckle fittings and by wearing larger and thicker socks or purchasing boots which were too small. Because of the rigidity of the boot shell, the tight fits frequently resulted in uncomfortable pressure areas because of the consequent distortion of the relatively rigid shell. The tight-fitting shell and liner also impaired blood circulation in the foot which resulted in coldness and fatigue.

SUMMARY OF THE INVENTION

In view of the foregoing, a principal object of the present invention is a dynamic internal fitting system for a sport shoe which dynamically adjusts the fit of the sport shoe to prevailing conditions of use.

Another object of the present invention is a fitting system as described above which adjusts the fit of the shoe as a function of the relative position of a foot and lower leg.

Still another object of the present invention is a fitting system as described above comprising a movable foot bed which moves with a relative movement of a foot and lower leg.

Still another object of the present invention is a fitting system as described above comprising means for engaging the upper surface of the foot which is movable and cooperates with the movable foot bed for adjusting the fit of a sport shoe.

Depending on the adjustments made by the user, a sport shoe according to the present invention and, in particular, a ski boot, according to the present invention, may be adjusted to fit a wide variety of foot sizes and shapes. With the movable foot bed, forward and rearward leans result in a tightening and loosening of the fitting system as a function of the relative position of the foot and lower leg. As the lower leg is bent toward the toe of the shoe, the movable foot bed is raised, tightening the fit of the shoe. As the leg is moved rearwardly toward the heel of the shoe, the foot bed is lowered, loosening the fit of the shoe.

The members engaging the upper surface of the foot are adjustable for adjusting the fit of the shoe for any given position of the foot bed in the shoe. With the various possible adjustments to the positioning of the foot bed and the upper foot engaging means, the fit of the shoe is widely variable.

DESCRIPTION OF THE DRAWING

The above and other objects, features and advantages of the present invention will become apparent from the following detailed description of the accompanying drawing in which:

FIG. 1 is a cross-sectional elevation view of a ski boot according to the present invention.

FIG. 2 is a rear elevation view of the ski boot of FIG. 1.

DETAILED DESCRIPTION OF THE INVENTION

Referring to FIGS. 1 and 2, there is provided in accordance with the present invention, a ski boot designated generally as 1. In the ski boot 1, there is provided a lower shell member 2, having a sole 3 and a cuff member 4 pivotally attached to the shell member 2 as by a fitting 5. The fitting 5 pivotally couples the cuff 4 to the lower shell member 2 in the vicinity of the ankle.

In the interior of the lower shell 2 and cuff 4, there is provided a relatively soft liner 6. To facilitate entry into the boot, the liner 6 divided into forward and rear sections 7 and 8, respectively along a line designated 9, extending from the middle of the top of the liner downwardly to the vicinity of the ankle area and then forwardly to a point approximately midway between the toe and the ankle area. The forward and rearward liner sections overlap by a small amount, as indicated by the dashed line, designated generally as 10 for warmth and comfort.

In the vicinity of the instep portion of the lower shell 2, between the interior wall of the shell 2 and the liner 6, there is provided a relatively stiff tongue member 15. Extending between the tongue member 15 and the interior wall of the shell 2, there is provided a pair of strap members 16 and 17. One end of the strap member 16 is attached, as by a rivet, glue or the like, to the sole 3 of the ski boot at a point 16' approximately midway between the arch of the boot and the toe of the boot. From its point of attachment to the sole of the ski boot, the strap 16 extends upwardly over the top of the tongue member 15 and is pivotally connected to one end of an elongated linking member 18. The other strap member 17 is coupled at one end to the sole 3 in the vicinity 17' of the heel of the shoe. From its point of attachment in the heel of the shoe, the strap member 17 extends over the tongue member 15 and is pivotally attached at its opposite end to the opposite end of the elongated linking member 18. For comfort, the strap members 16 and 17 pass over the exterior of the liner 6.

Pivotally coupled to the elongated linking member 18, at a point between the points of attachment of the strap members 16 and 17 thereto, there is provided a cable 20. The cable 20 extends from the linking member 18 to an adjusting mechanism designated generally as 21, which is movably mounted in the heel of the ski boot 1. In the adjusting mechanism 21, there is provided a movable shaft 22. The movable shaft 22 is movably mounted in the sole 3. The cable 20 is attached to the shaft 22 in any suitable manner. A knob or slot for receiving a screw driver is provided in the end of the shaft and is accessible from the exterior of the boot for rotating the shaft for adjusting the tension applied to the cable 20. Ratchet means or the like with suitable ratchet-releasing mechanisms (not shown) are provided for rotating the shaft 22 in opposite directions and for locking the shaft in intermediate positions.

Located interior of the sole 3, there is provided a movable foot bed 25. The foot bed 25 is movably attached to the sole 3 at the toe thereof by means of a hinge 26. At the rear or heel of the foot bed 25, there is provided a cable 27. The cable 27 is attached to the rear end of the foot bed 25 and extends through a cable slot 28, provided therefor in the liner 6 and cuff 4 to an adjusting buckle 29.

In the adjusting buckle 29 there is provided a plurality of cable-receiving members or hooks 30. At the lower end of the buckle 29, there is provided a cable-guiding roller or member 31. The buckle 29 is attached to the cuff 4 by means of a hinge 32. The cable 27 may comprise a pair of cable members extending from spaced points at the rear of the movable foot bed 25 to the buckle 29 or it may comprise a single cable member extending to the buckle 29 for engaging one of the adjusting members 30. On the interior surface of the foot bed 25 there is provided for comfort and warmth the sole portion 6' of the liner 6.

In use, as a skier leans forward, as during a turn, the forward bending of the lower leg causes the cuff 4 to move towards the toe of the boot. As the cuff 4 moves toward the toe of the boot, the buckle 29 pulls on the cable 27 attached to the movable foot bed 25. As the cable 27 is pulled, the cable 27 lifts the movable foot bed 25 from a downwardly, rearwardly sloping cavity 33 provided therefor in the sole 3 of the boot 1. Conversely, as a skier leans rearwardly, moving the cuff member 4 toward the heel of the boot, the movable foot bed 25 is permitted to lower into the cavity 33.

As the foot bed 25 moves up and down relative to the straps 16 and 17, the fit of the boot tightens and loosens. Thus, during a turn when a tight fit is required, the movable foot bed 25 provides a tight fit. On the other hand, during a traverse or when a skier is standing upright, the foot bed is lower in the cavity 33, providing a relatively loose fit. In this fashion, the fit of the ski boot conforms more closely to the actual needs of the skier.

In addition to the dynamic adjustment of the foot bed with movement of the cuff member 4, the position of the foot bed may be raised and lowered by releasing the buckle 29 and moving the point of attachment of the cable 27 thereto. Thus, to raise the foot bed, the cable 27 is attached to a higher one of the plurality of the members 30. To lower the foot bed, the cable 27 is attached to a lower one of the cable attachment members 30. Further adjustments are possible by adjusting the tension applied to the strap members 16 and 17.

To adjust the tension applied to the strap members 16 and 17, the shaft 22, to which the cable 20 is attached, is rotated. Depending on the direction of rotation, the amount of cable wrapped about the shaft 22 is changed.

In addition to the embodiment described and the several alternative features suggested, it is contemplated that still other modifications may occur to those skilled in the art without departing from the spirit and scope of the present invention. For example, the cable 27 may be attached to the foot bed 25 at points other than the rear of the foot bed as illustrated. By changing the point of attachment, the magnitude of relative movement of the cuff and foot bed may be changed. Accordingly, it is intended that the scope of the invention not be limited to the embodiments described but rather be determined by reference to the claims hereafter provided and their equivalents.

What is claimed is:

1. A sport shoe comprising:

means forming a movable foot bed located in the interior of said shoe for controlling foot movement in the shoe; and means responsive to a movement of the lower leg for moving said foot bed to tighten and loosen the fit of the shoe relative to said foot as said lower leg is moved.

2. A sport shoe according to claim 1 wherein said foot bed is movable about a point located in the forward part of said foot bed and said foot bed moving means comprises means for moving said foot bed about said point.

3. A sport shoe according to claim 1 comprising:

adjustable upper foot restraining means for engaging the upper surface of a foot located in the interior of said sport shoe; and means for adjusting the position of said upper foot restraining means relative to said foot bed.

4. A sport shoe according to claim 2 comprising means forming a movable cuff member and wherein said foot bed moving means comprises means coupling said foot bed to said cuff member for moving said foot bed as said cuff member is moved.

5. A sport shoe according to claim 3 wherein said upper foot engaging means comprises strap means.

6. A sport shoe according to claim 4 wherein said means coupling said foot bed to said cuff member comprises means for raising and lowering said foot bed as said cuff is moved.

7. A sport shoe according to claim 5 wherein said strap means comprises:

a first strap attached at one end to the interior of said sport shoe in the forward part thereof and a second strap attached at one end to the interior of said sport shoe in the vicinity of the heel thereof;

an elongated linking member;

means for attaching the opposite ends of said first and second straps to opposite ends of said elongated linking member;

a cable; and means for coupling one end of said cable to said linking member between said first and second straps and the opposite end of said cable to the interior of said sport shoe in the vicinity of the heel thereof.

8. A sport shoe according to claim 6 wherein said means for raising and lowering said foot bed comprises means for raising said foot bed when said cuff is moved toward the toe of said shoe and lowering said foot bed when said cuff is moved toward the heel of said shoe.

9. A sport shoe according to claim 7 wherein said means for adjusting the position of said upper foot restraining means comprises movable adjusting means located in the vicinity of the heel of said sport shoe and means for coupling said cable from said linking member to said adjusting means.

10. A sport shoe according to claim 8 comprising first adjusting means for adjusting the position of said foot bed in said shoe independent of the position of said cuff relative thereto.

11. A sport shoe according to claim 8 comprising second adjusting means for adjusting the magnitude of the relative movement of said foot bed and cuff.

12. A sport shoe according to claim 10 wherein said first adjusting means comprises an adjusting apparatus mounted to said cuff member and means for coupling said adjusting apparatus to said foot bed.

13. A sport shoe according to claim 11 wherein said second adjusting means comprises means for adjusting the position of the point of attachment of said coupling means coupling said cuff and said foot bed.

14. A sport shoe according to claim 12 wherein said first adjusting means comprises an adjustable buckle member coupled to the rear of said cuff member and said coupling means comprises a cable for coupling said adjustable buckle member to said foot bed.

15. A sport shoe according to claim 14 wherein said sport shoe comprises a liner interior of said cuff and exterior of said foot bed and a cable-receiving slot located in said liner and said cuff for coupling said cable between said foot bed and said adjustable buckle, said slot having a size and shape permitting unimpaired movement of said cable as said foot bed is raised and lowered.

* * * * *